US005647948A

United States Patent [19]

Paridis

[11] Patent Number: 5,647,948

[45] Date of Patent: Jul. 15, 1997

[54] DEVICE FOR APPLYING AN ADHESIVE SUBSTANCE IN PARTICULAR ON CARPET BOTTOM SUPPORT STRIPS

[76] Inventor: Georgios Paridis, Garterlaie 40, D-42327 Wuppertal, Germany

[21] Appl. No.: 376,855

[22] Filed: Jan. 23, 1995

[30] Foreign Application Priority Data

Jul. 2, 1994 [DE] Germany ..... 9410692 U

[51] Int. Cl.[6] ..... B05C 5/00

[52] U.S. Cl. ..... 156/578; 222/486; 226/19

[58] Field of Search ..... 156/578, 184, 156/289; 118/410, 411, 668, 669; 271/248; 226/15, 19, 154, 155, 186; 222/485, 486

[56] References Cited

U.S. PATENT DOCUMENTS

| | | | |
|---|---|---|---|
| 2,710,120 | 6/1955 | Thomsen | 222/486 |
| 2,796,847 | 6/1957 | Guggenheim | 118/411 |
| 3,032,239 | 5/1962 | Whitley, Jr. et al. | 222/486 |
| 3,114,489 | 12/1963 | Legler | 226/15 X |
| 3,420,208 | 1/1969 | Guthrie | 118/411 X |
| 4,157,149 | 6/1979 | Moen | 118/411 X |
| 4,988,551 | 1/1991 | Zegler | 156/184 X |
| 5,048,453 | 9/1991 | Eriksson | 118/258 X |
| 5,344,058 | 9/1994 | Baffo | 226/186 X |
| 5,435,847 | 7/1995 | Shibata et al. | 118/410 |

*Primary Examiner*—James Engel
*Attorney, Agent, or Firm*—Jones & Askew, LLP

[57] ABSTRACT

Apparatus for applying tracks of an adhesive substance on strip-shaped material, in particular to the back of bottom support strips that consist of strips of carpet. A guiding and transporting device transports the material in its longitudinal direction and a device for applying the adhesive substance is arranged vertically on top of an approximately horizontal area of movement of the material. A nozzle arrangement, consisting of several outlet nozzles for the adhesive substance, is distributed over the width of the material, and the number of active outlet nozzles that apply the adhesive substance may be altered so as to adapt the device to different material widths. Each outlet nozzle may be activated or deactivated individually as well as independently of the other outlet nozzles.

12 Claims, 4 Drawing Sheets

Figure 1:
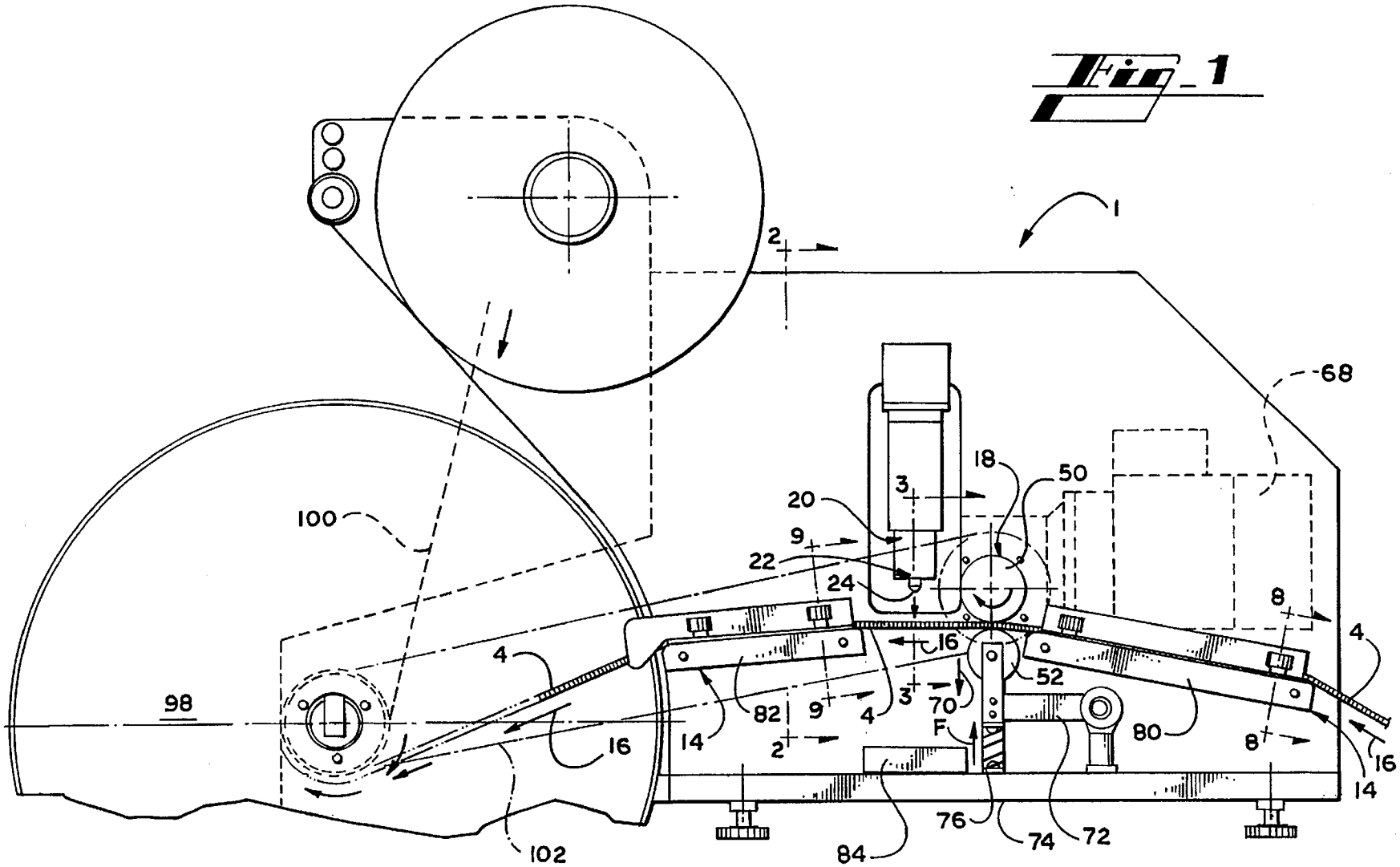

1
2
2
3
3
4
4
4
8
8
9
9
14
14
16
16
16
18
20
22
24
50
52
68
70
72
74
76
80
82
84
98
100
102
F

DEVICE FOR APPLYING AN ADHESIVE SUBSTANCE IN PARTICULAR ON CARPET BOTTOM SUPPORT STRIPS

The present invention pertains to a device for applying tracks of an adhesive substance (beads) on strip-shaped material, in particular to the back of bottom support strips that consist of strips of carpet, with a guiding and transporting device for transporting the material in its longitudinal direction and with a device for applying the adhesive substance that is arranged vertically on top of the approximately horizontal area of movement of the material, and which comprises a nozzle arrangement consisting of several outlet nozzles for the adhesive substance that are distributed over the width of the material, wherein the number of active outlet nozzles that apply the adhesive substance may be altered so as to adapt the device to different material widths.

In order to obtain a visually attractive baseboard edge on carpeted floors, there exist carpet bottom support strips which usually consist of long, joined strips of the same carpet material as the carpet installed on the floor. Such bottom support strips usually are glued to the wall, wherein an adhesive substance is applied onto the rear of the carpet strip and covered with a removable protective layer (e.g., silicone paper or foil) during the prefabrication. These measures allow a very simple and fast installation which simply requires that the protective layer be removed and the bottom support strips be pressed against the wall. A carpet bottom support strip of this type is described in German Patent No. 3,706,412.

There already exists one device for the aforementioned application of the adhesive substance on the material strip, wherein the device for applying the adhesive substance comprises a sliding valve. In this case, the outlet nozzles may be opened or closed successively by means of a slide. This embodiment exclusively serves for adapting the application of the adhesive substance to the different widths of the material by opening and consequently "activating" a smaller number of nozzles for narrower strips and a larger number of nozzles for wider strips. However, this device is associated with the disadvantage that the quantity of the adhesive substance to be applied to identical material widths only may be varied collectively for all "active" nozzles via a valve that is arranged in front of said nozzles such that the thickness of each respective track of the adhesive substance (bead) is changed; in unfavorable instances, this may even lead to a break or interruption of the beads or their becoming so "thick" that they run into one another.

The present invention is based on the objective of creating a device of the aforementioned type by means of which the application of the adhesive substance may be metered in a superior fashion without causing disadvantageous changes of the quantity applied in the individual tracks (beads).

According to the invention, this objective is attained in that each outlet nozzle for the adhesive substance may be activated or deactivated individually as well as independently of the other outlet nozzles. For this purpose, an adhesive substance supply channel is arranged in front of each outlet nozzle, and each supply channel may be opened or closed individually by means of a closing element.

The invention allows an advantageous metering of the quantity of the adhesive substance to be applied by carrying out a targeted selection of the "active" outlet nozzles. The quantity to be applied may, for example, be reduced by only activating each second or third nozzle of the row of nozzles, wherein a uniform distribution of the beads consisting of the adhesive substance still is attained over the width of the material. Each nozzle may discharge such a quantity of the adhesive substance that optimum and continuous beads are produced. It goes without saying that the individual actuation of the nozzles according to the invention may also be utilized for adapting the device to different material widths; the nozzles that lie "outside" of the material width need only be deactivated (closed).

Additional advantageous embodiments of the invention are disclosed in as the following description.

Figure 2:
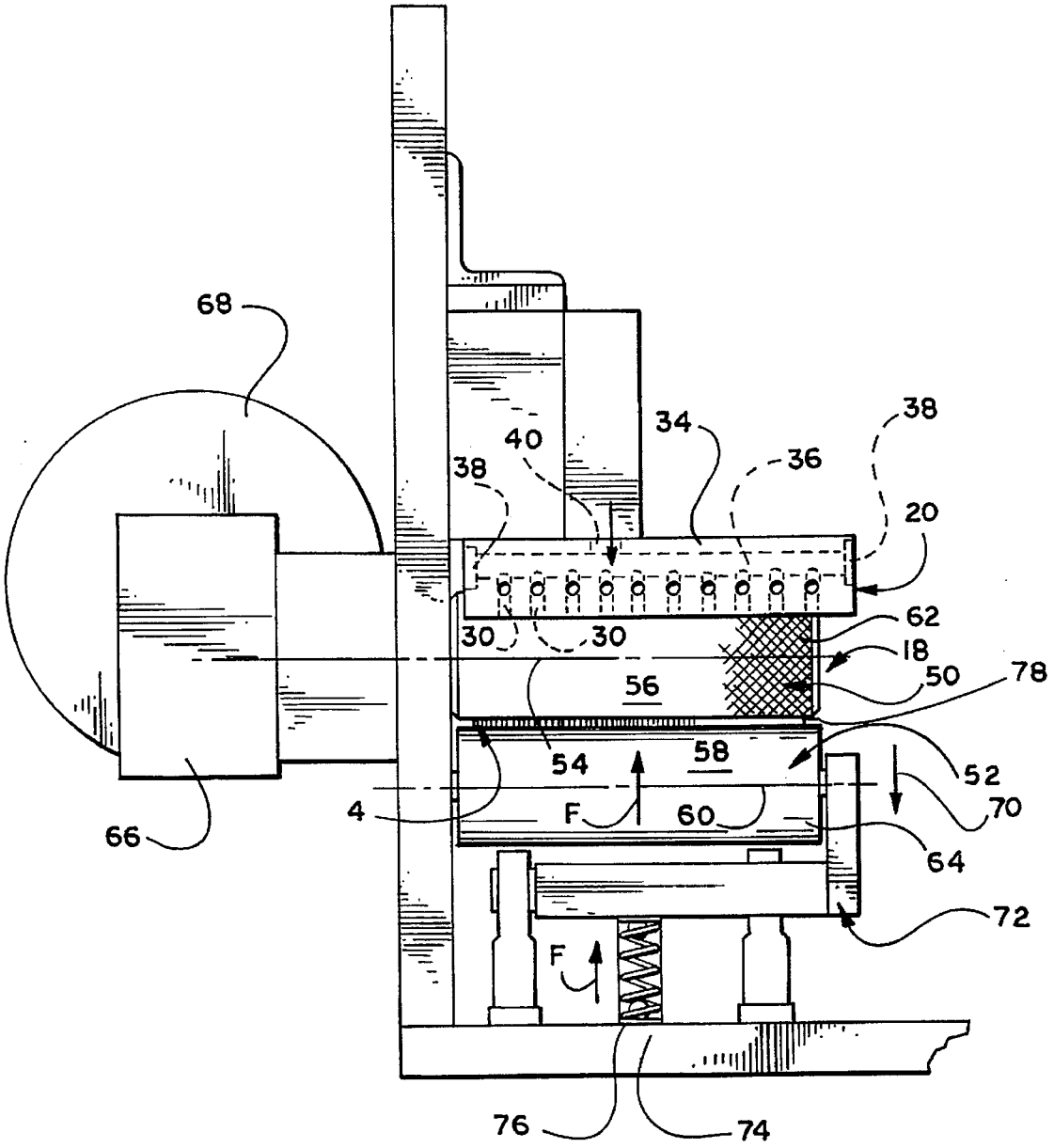
Figure 3:
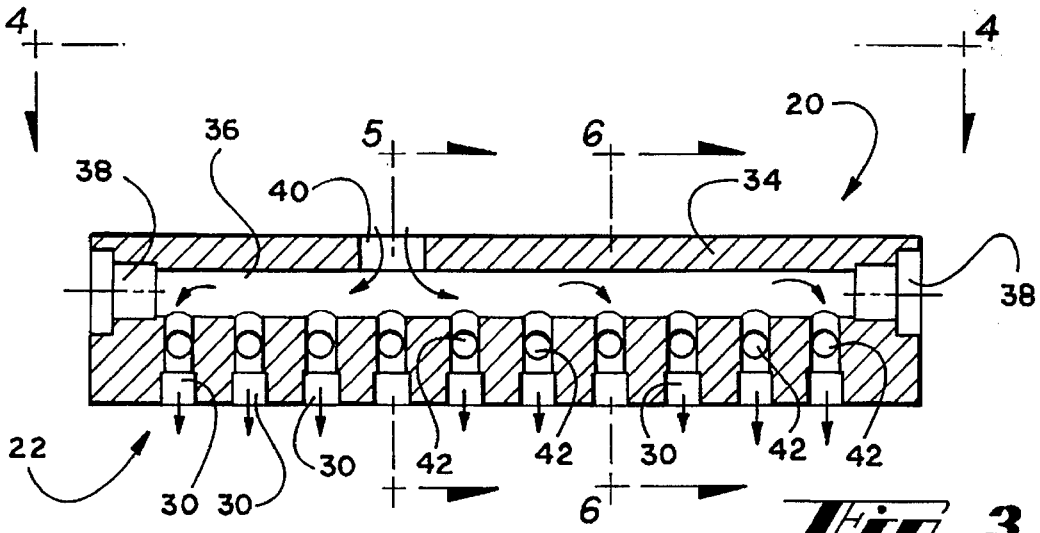
Figure 4:
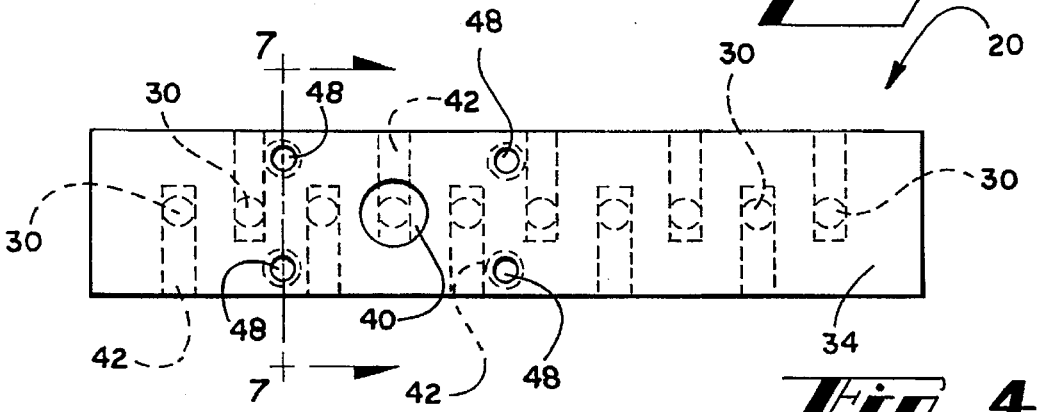
Figure 5:
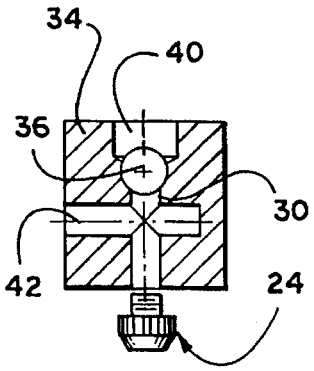
Figure 6:
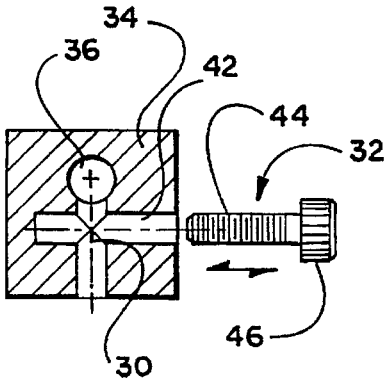
Figure 7:
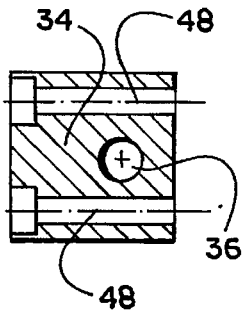
Figure 8:
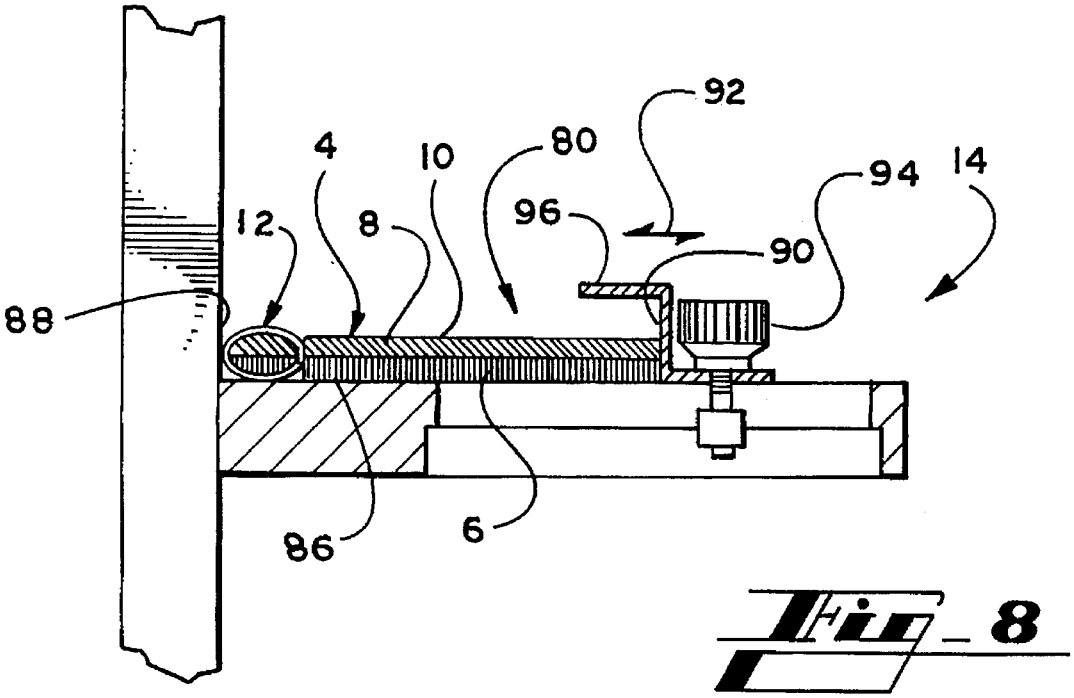
Figure 9:
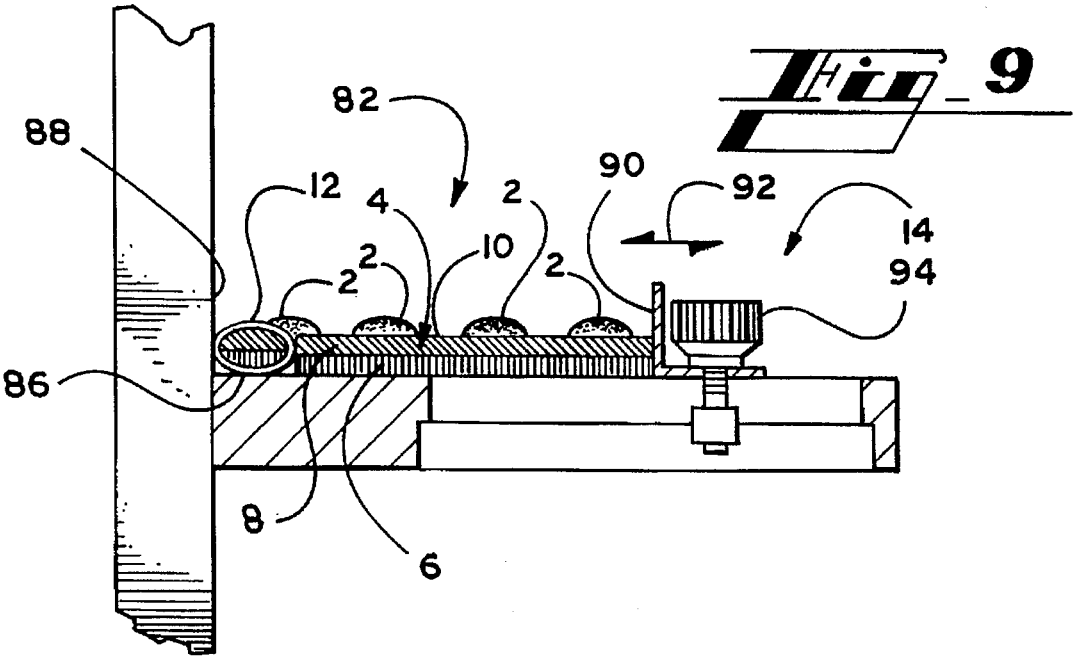

The device according to the invention is described below in detail with reference to one preferred embodiment that is illustrated in the figures. The figures show:

FIG. 1: a side view of a device according to the invention, i.e., in a viewing direction that extends horizontally and perpendicular to the material transport direction during the application of beads consisting of an adhesive substance on a carpet bottom support strip, FIG. 2: an enlarged partial front view, in particular of the region of the device for applying the adhesive substance and a transport device that is arranged in front of the aforementioned device for applying the adhesive substance viewed in the direction of arrow 2 of FIG. 1, FIG. 3: an enlarged section through the device for applying the adhesive substance along line 3—3 of FIG. 1, FIG. 4: a top view viewed in the direction of arrow 4 of FIG. 3, FIG. 5: a cross section along line 5—5 of FIG. 3, FIG. 6: a cross section along line 6—6 of FIG. 3, FIG. 7: a cross section along line 7—7 of FIG. 4, FIG. 8: an enlarged cross section through the material guide within the intake region (along line 8—8 of FIG. 1), and FIG. 9: an enlarged cross section through the material guide in the outlet region (along line 9—9 of FIG. 1).

In the different figures, identical components always are identified by identical reference symbols, so that each description of a part that only occurs once applies in analogous fashion to the other figures in which this particular part also is identified by the corresponding reference symbol.

In the illustrated embodiment, a device 1 according to the invention is provided for applying tracks of an adhesive substance (so-called beads) 2—see FIG. 9—on carpet bottom support strips 4. According to FIGS. 8 and 9, bottom support strips 4 of this type consist of a strip-shaped carpet material with a conventional pile or web layer 6, a carpet base 8 that carries the aforementioned pile or web layer and a back 10 (rear surface) that is situated opposite to the pile or web layer 6. The pile or web layer 6 may consist of closed naps (bouclé) or cut naps (velour). The carpet base 8 usually consists of cellular material, rubber, PVC, a textile fabric or needle punched felt. One longitudinal edge of the bottom support strip 4 usually is provided with a border 12 that is formed of thread loops. A bottom support strip of this type is described in the initially mentioned German Patent No. 3,706,412, which is referred to at this point in its entirety.

FIG. 1 shows that the device 1 comprises a material guide 14 for guiding the strip-shaped material or the bottom support strip 4 in its longitudinal direction (movement direction according to the arrow 16 shown in the figure) as well as a transport device 18 that directly applies a driving force to the bottom support strip 4 so as to transport the bottom support strip relative to a device 20 for applying the adhesive substance that is arranged vertically on top of an essentially horizontal area of movement. This application device 20 comprises a nozzle arrangement 22 consisting of a row of outlet nozzles 24 for the adhesive substance that are distributed over the width of the material strip or the bottom support strip 4. These outlet nozzles discharge a freely flowing adhesive substance, in particular a hot-melt adhesive, which is applied downward due to gravity to the back 10 of the bottom support strip 4 in order to form the beads 2.

According to the invention, each outlet nozzle 24 for the adhesive substance may be activated or deactivated individually and independently of the other outlet nozzles 24. According to FIGS. 3–6, it is advantageous if a supply channel 30 for the adhesive substance is arranged in front of each outlet nozzle 24 (which [nozzles] are only illustrated in the unassembled condition in FIG. 1 as well as FIG. 5), wherein each supply channel 30 may be individually opened or closed by means of a closing element 32 (illustrated only in FIG. 6). In the preferred embodiment, the application device 20 is provided with an oblong, essentially block-shaped or right parallelepiped distribution body 34, wherein a longitudinal channel 36 that is closed on both sides via closing elements 38 (FIG. 3) initially extends through the aforementioned distribution body in the longitudinal direction (=transverse direction of the material 4 to be provided with the adhesive substance). An intake opening 40 that is connected to an adhesive substance reservoir (not illustrated in the figure) exits into the longitudinal channel 36 from one side (vertically from the top). In addition, the supply channels 30 that are arranged in front of the outlet nozzles 24 originate from the longitudinal channel 36.

It is preferred that a thermoplastic adhesive substance (hot-melt adhesive) be used, wherein the adhesive substance reservoir may be heated so as to make the adhesive substance flow freely in order to apply said adhesive substance to the material 4 where it subsequently cools correspondingly.

FIGS. 3–6 additionally show that each supply channel 30 has a transverse hole 42 into which a plug 44 may be inserted as a closing element 32 in such a way that said plug interrupts and consequently closes the supply channel 30. The supply channels 30 are opened by removing the plug 44. Each transverse hole 42 preferably is designed as a threaded hole, wherein each plug 44 is correspondingly constructed as a threaded screw (see FIG. 6). This means that each respective supply channel 30 may be closed by inserting the threaded screw into the transverse hole 42 or opened by removing said threaded screw from the transverse hole, wherein an advantageous metering process may be carried out by altering the effective cross section of the supply channel 30 by means of the plug 44 or the threaded screw.

FIGS. 4, 5 and 6 in particular show that the supply channels 30 are arranged in a row that extends perpendicular to the strip-shaped material 4 in accordance with the nozzle arrangement 22. The supply channels extend parallel to one another through the distribution body 34, wherein the transverse holes 42 preferably are designed as blind holes that alternately originate from opposite sides of the distribution body 34 (FIGS. 5 and 6). This measure provides sufficient space, in particular for manually actuated heads 46 of the plugs 44, i.e., even if the nozzles are arranged very close and adjacent to one another.

The preferred embodiment of the device 20 for applying the adhesive substance or the distribution body 34 which is illustrated in the figures and which has been described thus far advantageously results in an exceptionally simple and inexpensive construction, in particular of the closing elements 32. However, the scope of the invention also includes a variation in which the closing elements are designed as electrically actuated valves, but this particular variation is associated with additional constructive expenditures.

The supply of the adhesive substance—in addition to the closing elements 32—preferably may be controlled on the intake side via one collective valve (not shown in the figures). This means that the supply of the adhesive substance may be opened, closed, as well as metered via this collective valve. In this case, it is also particularly practical if the valve that controls the supply of the adhesive substance be controlled by a material sensor (also not shown in the figures) in such a way that the adhesive substance is only supplied if a material 4 to be provided with the adhesive substance is arranged underneath the application device 20 and the supply of the adhesive substance is automatically interrupted after the end of the material 4 has passed the material sensor. The material sensor provided for this purpose may be designed as an electromechanical switch that senses the material 4. Alternatively, it is also possible to provide other sensors, e.g., an optoelectrical switch (light barrier).

FIG. 7 and, in particular, FIG. 4 show that the distribution body 34 comprises several fastening holes 48 in order to be fastened or connected to an adhesive substance reservoir, wherein it goes without saying that said fastening holes are arranged within a region that lies outside of the longitudinal channel 36 and the intake opening 40 as well as between the transverse holes 42.

In addition, it is advantageous if the transporting device 18 consists of a driving element 50 that acts upon the side (the back 10) of the material or the bottom support strip 4 to be provided with the adhesive substance and may be driven via a motor as well as a pressing element 52 that acts upon the opposite side of the material (the side of the pile or web layer 6) and is activated in the direction of the opposite driving element 50 via a spring force F. This special characteristic also is mentioned in an application by the applicant which has the internal file number 7114 and the same priority. This application is referred to in its entirety. According to this application, the driving element 50 preferably is constructed as a drive roll 56 that may be driven in a rotating fashion and is arranged around an axis of rotation 54—see FIG. 2—that extends parallel to the plane of the bottom support strip 4 and perpendicular to the moving direction 16 of the material. In this case, it is practical that the pressing element 52 be constructed as a pressing roller 58 which is arranged in a freely rotatable fashion on an axis of rotation 60 that extends parallel to the plane of the bottom support strip 4 as well as perpendicular to the moving direction 16 of the material, and consequently parallel to the axis of rotation 54 of the drive roll 56. Consequently, the drive roll 56 acts upon the back 10 or the carpet base 8 of the bottom support strip 4, wherein it is advantageous that the drive roll 56 consist of a relatively hard and dimensionally stable material, in particular steel, and be provided with a rough surface, in particular a cross-knurled surface 62 (compare to FIG. 2). Since the pressing roller 58 only rotates freely, it basically may have any arbitrary surface, i.e., even a smooth surface 64. Consequently, the pressing roller 58 preferably is manufactured of an essentially smooth steel material.

The bottom support strip 4 to be transported in practice is clamped between the drive roll 56 and the pressing roller 58, wherein the transport takes place in accordance with the rotation of the drive roll 56, preferably, with almost no slippage.

In this case, the drive roll 56 is—in particular via a worm gear pair 66 shown in FIG. 2—connected to an electromotive drive 68, preferably a speed-controlled three-phase motor. A frequency converter control in conventional fashion serves for regulating the speed control, preferably in such a way that the transport speed may be variably regulated between zero and a maximum speed which, due to the measures according to the invention, may reach significant values of up to approximately 21 m/min. In this case, the motor speed lies within a range between zero and approximately 2800 rpm.

FIGS. 1 and 2 show that the pressing element 52 is preferably arranged in such a way that it may be freely moved in the direction away from the driving element 50 (approximately vertically downward in the direction of the arrow 70) against the spring force F—in particular by means of a handle (not shown in the figures). This advantageous measure simplifies the manual insertion of the material strip to be processed by pressing down the pressing element 52 such that an additional insertion gap is formed between the driving element 50 and the pressing element 52. The construction of this in the illustrated embodiment is realized by arranging the pressing element 52 of an oscillating crank arrangement 72 that is arranged in a pivoted fashion (compare to FIGS. 1 and 2), wherein (at least) one prestressed pressure spring 76 is arranged between the movable oscillating crank arrangement 72 and a stationary support 74 on the side of the machine frame in order to generate the spring force F. In this case, the magnitude of the spring force F may be adjustable.

In addition, it is advantageous if the pressing movement of the pressing element 52 in the direction toward the driving element 50 which is caused by the spring force F is limited by means of a limit stop (not shown in the figures), wherein said limit stop preferably is adjustable in such a way that a gap 78 (see FIG. 2) between the driving element 50 and the pressing element 52 may be limited to a variable minimum distance. This means that the gap 78—due to the thickness of the material 4 to be processed—may become larger, but not smaller. This measure advantageously prevents an excessive pressing together of the bottom support strip 4 due to the high spring force F. In addition, this measure contributes to a careful treatment of the material.

FIG. 1 shows that the material guide 14 is designed as a two-part guide; it consists of an intake guide 80 and an outlet guide 82 that has a certain distance from the intake guide in the moving direction 16 of the material. In this case, the transporting device 18 is arranged within the region between the intake guide 80 and the region situated vertically underneath the device 20 for applying the adhesive substance according to the invention. The application device 20 is consequently arranged between the transporting device 18 and the beginning of the outlet guide 82. This means that no guiding or transporting elements are situated underneath the application device 20 such that a container 84 for collecting drops of the adhesive substance may be arranged vertically underneath the application device 20 and the movement area of the bottom support strip 4. This measure advantageously prevents the soiling of the parts of the device that come into contact with the material 4.

It is practical that the material guide 14 be designed in an adjustable fashion in order to be adapted to the different widths of the bottom support strips 4. This aspect is discussed in detail below with reference to FIGS. 8 and 9.

The intake guide 80 (FIG. 8) and the outlet guide 82 (FIG. 9) each comprise a support 86 for the bottom support strip 4, a first, stationary lateral guide 88 as well as a second, adjustable lateral guide 90. The adjustability of the second lateral guide 90 is indicated by a double arrow 92. The construction of the second lateral guide 90 may, as shown, be realized as an angular element that is retained in oblong holes via locking screws 94. This feature in particular is illustrated in FIGS. 8 and 9. In addition, a vertical guide 96 is provided, in particular within the region of the intake opening 80, wherein said vertical guide preferably is designed as a fixed link that is connected to the second, adjustable lateral guide 90 and extends over the intake region of the material 4.

According to FIG. 1, the material or the bottom support strip 4 is guided from the outlet guide 82 to a winding device 98—preferably a winding device that forms a direct component of the device 1 according to the invention—wherein the winding device winds the material 4 that was provided with the adhesive substance while simultaneously covering the adhesive substance with a strip-shaped protective material 100 (e.g., silicone paper or the like). The winding device 98 preferably is driven by the same drive 68 as the driving element 50, wherein a sliding clutch (not shown in the figures) is arranged between the drive 68 and the winding device 98. In this case, it is particularly advantageous if the sliding clutch is connected to the drive 68 without slippage, wherein said fact may, in particular, be realized by a chain drive 102 or the like (indicated by the dotted-dashed lines of FIG. 1). Due to this advantageous measure, the transmission of power between the drive 68 and the input side of the sliding clutch takes place without slippage, so that only the defined or exactly definable slippage takes place within the sliding clutch. In addition, the sliding clutch preferably is adjustable with respect to its slippage or the torque transferred onto the winding device 98 via said sliding clutch; however, the slippage is very constant in this case. In addition, a very exactly defined winding torque is attained due to this measure.

The invention is not limited to the illustrated and described embodiments, but rather includes all embodiments that function identically in the sense of the invention. In addition, the invention thus far is not limited to the combination of characteristics defined in the claims, but also may be defined by any other arbitrary combination of certain characteristics of all individual characteristics disclosed. This means that in principle practically each individual characteristic of the claims may be omitted or replaced by at least one individual characteristic disclosed at a different text portion of the application.

I claim:

1. Apparatus for applying tracks (2) of an adhesive substance to strip-shaped material (4), comprising:

means (14) for guiding and transporting the material in its longitudinal direction; and means (20) arranged above an approximately horizontal area of movement of the material (4) guided and transported by the means (14) and operative to apply the adhesive substance to the material, said means (20) comprising a nozzle arrangement having several outlet nozzles (24) for the adhesive substance, the outlet nozzles being distributed over the width of the material;

each outlet nozzle (24) having an individual supply channel (30) for the adhesive substance, and each supply channel (30) having a transverse hole (42); and an individual closing element (32) operatively associated with each outlet nozzle (24);

each closing element (32) comprising a plug (44) selectively inserted into the transverse hole (42) of a corresponding said supply channel (30) in operative relation to the supply channel such that the supply channel is closed in the inserted condition of the plug (44), whereby each outlet nozzle is selectively activated or deactivated individually as well as independently of the other outlet nozzles (24) by means of the closing element (32) associated with that outlet nozzle, so that the number of active outlet nozzles that apply the adhesive substance is selectively altered by operation of the closing elements so as to adapt the apparatus to different material widths.

2. Device according to claim 1, characterized by the fact that the means (20) for applying the adhesive substance comprises a distribution body (34) with a longitudinal channel (36), wherein one intake opening (40) exits into the longitudinal channel (36) and the supply channels (30) that are arranged in front of the outlet nozzles (24) originate from the longitudinal channel (36).

3. Device according to claim 1, characterized by the fact that each transverse hole (42) is designed as a threaded hole, and that each plug (44) is designed as a threaded screw.

4. Device according to claim 1, characterized by the fact that the supply channels (30) are arranged in a row and extend parallel to one another through the distribution body (34), and the transverse holes (42) are blind holes that alternately originate from opposing sides of the distribution body (34).

5. Device according to claim 1, characterized by the fact that the supply of the adhesive substance may be controlled on the intake side via a valve.

6. Device according to claim 5, characterized by the fact that the valve controlling the supply of the adhesive substance is controlled by a material sensor in such a way that only the adhesive substance is supplied if the material (4) to be provided with the adhesive substance is situated underneath the application device (20), and that the supply of the adhesive substance is automatically interrupted after the end of the material (4) has passed the material sensor.

7. Device according to claim 6, characterized by the fact that the material sensor is designed as an electromechanical switch that senses the material (4).

8. Device according to claim 1, characterized by the fact that the guiding and transporting device comprises a material guide (14) and a transporting device (18), wherein the material guide (14) has an intake guide (80) and an outlet guide (82) that is arranged at a distance from the aforementioned intake guide in the moving direction (16) of the material, and the transporting device (18) is arranged within the region between the intake guide (80) and the outlet guide (82), and that the device (20) for applying the adhesive substance is arranged vertically on top of the region situated between the transporting device (18) and the outlet guide (82).

9. Device according to claim 8, characterized by the fact that the material guide (14) is designed in an adjustable fashion so as to adapt to the different widths of the strip-shaped material (4).

10. Device according to claim 1, characterized by the fact that a container (84) for collecting drops of the adhesive substance is arranged vertically underneath the nozzle arrangement (22) of the device (20) for applying the adhesive substance and below the area of movement of the material.

11. Device according to claim 1, characterized by the fact that the transporting device (18) comprises a driving element (50) that is selectively driven via an electromotive drive (68) and acts upon the side (10) of the material material (4) to be provided with the adhesive substances and a pressing element (52) that acts upon the opposite side (6) of the material, and is charged with a spring force (F) in the direction toward the driving element (50).

12. Device according to claim 1, characterized by a winding device (98) that is arranged behind the application device in the moving direction (16) of the material and preferably driven by the same drive (68) as the transporting device (18) via a sliding clutch, wherein the material (4) that is provided with the adhesive substance may be wound by means of said winding device, in particular while covering the adhesive substance with a strip-shaped protective layer (100).

* * * * *

UNITED STATES PATENT AND TRADEMARK OFFICE

CERTIFICATE OF CORRECTION

PATENT NO. : 5,647,948

DATED : July 15, 1997

INVENTOR(S) : Georgios Paridis

It is certified that error appears in the above-indentified patent and that said Letters Patent is hereby corrected as shown below:

In column 8, line 25, delete the second occurrence of "material".

Signed and Sealed this

Twenty-third Day of September, 1997

*Attest:*

Bruce Lehman

BRUCE LEHMAN

*Attesting Officer*

*Commissioner of Patents and Trademarks*